US009635444B2

(12) United States Patent
Hose et al.

(10) Patent No.: US 9,635,444 B2
(45) Date of Patent: Apr. 25, 2017

(54) DECORATIVE FLAT PANEL SOUND SYSTEM

(71) Applicant: SoundWall LLC, Boulder, CO (US)

(72) Inventors: David Hose, Boulder, CO (US); Sven Coppom, Boulder, CO (US)

(73) Assignee: SoundWall LLC, Boulder, CO (US)

( * ) Notice: Subject to any disclaimer, the term of this patent is extended or adjusted under 35 U.S.C. 154(b) by 0 days.

(21) Appl. No.: 14/214,039

(22) Filed: Mar. 14, 2014

(65) Prior Publication Data

US 2015/0071475 A1 Mar. 12, 2015

Related U.S. Application Data

(60) Provisional application No. 61/786,051, filed on Mar. 14, 2013.

(51) Int. Cl.
*H04R 1/20* (2006.01)
*H04R 1/02* (2006.01)
(Continued)

(52) U.S. Cl.
CPC ..... *H04R 1/023* (2013.01); *H04R 1/026* (2013.01); *H04R 3/02* (2013.01); *H04R 7/045* (2013.01);
(Continued)

(58) Field of Classification Search
CPC .. H04R 1/023; H04R 1/026; H04R 2201/021; H04R 17/00; H04R 7/04; H04R 25/00
USPC ..... 381/346, 386, 378, 314, 323, 423, 424, 381/77, 80, 61, 74; 375/242, 241, 500; 341/50; 340/384.6
See application file for complete search history.

(56) References Cited

U.S. PATENT DOCUMENTS 4,860,369 A * 8/1989 Koshimura ..... H04R 1/025 181/148
6,215,884 B1 4/2001 Parrella et al.
(Continued)

FOREIGN PATENT DOCUMENTS

DE 202011050962 11/2012
JP 62005798 1/1987
(Continued)

OTHER PUBLICATIONS

Japanese Office Action, dated Oct. 4, 2016, for Application 2016-503082.
(Continued)

*Primary Examiner* — M D S Elahee
*Assistant Examiner* — Julie X Dang
(74) *Attorney, Agent, or Firm* — Marsch Fischmann & Breyfogle LLP; Kent A. Fischmann

(57) ABSTRACT

A flat panel sound system (400) includes an acoustic backing (410) and stand-offs (412) on its back side. The stand-offs (412) are interposed between a frame (406) or housing (408) and the wall on which the sound system (400) is mounted. The sound system (400) further includes an electronic housing (414) and exciters (404) mounted on the frame (406). The electronics within the electronic housing (414) receive wireless inputs from a user interface and drive the exciters (404) to produce an audio output. The stand-offs (412) inhibit transmission of vibrations to the wall and allow acoustic waves to emanate the back side of the flat panel system.

30 Claims, 6 Drawing Sheets

(51) Int. Cl.
*H04R 7/04* (2006.01)
*H04R 3/02* (2006.01)

(52) U.S. Cl.
CPC ..... *H04R 1/028* (2013.01); *H04R 2201/021* (2013.01); *H04R 2420/07* (2013.01)

(56) References Cited

U.S. PATENT DOCUMENTS

2001/0017927 A1 8/2001 Bachmann et al.
2002/0094108 A1* 7/2002 Yanagawa ..... H04R 7/08 381/423
2002/0101135 A1* 8/2002 Giovanardi ..... G10K 11/178 310/328
2003/0095152 A1 5/2003 Fong
2003/0123679 A1* 7/2003 Dudleston ..... H04R 1/025 381/87
2003/0183443 A1* 10/2003 Busque ..... H04R 7/045 181/150
2005/0245191 A1* 11/2005 Falcon ..... G11B 23/049 455/3.06
2007/0030985 A1* 2/2007 Cheung ..... H04R 7/045 381/152
2007/0217446 A1 9/2007 Moorer et al.
2007/0277449 A1* 12/2007 Burns ..... E04F 13/081 52/36.4
2008/0276794 A1* 11/2008 Juszkiewicz ..... G10H 1/0058 84/742
2009/0196455 A1 8/2009 Lee
2010/0239101 A1* 9/2010 Okamura ..... H04R 1/005 381/71.1
2011/0216921 A1 9/2011 Tseng et al.
2011/0283632 A1* 11/2011 Sutton ..... A47B 46/005 52/36.1
2012/0297959 A1* 11/2012 Serletic ..... G06F 3/0481 84/626
2014/0064515 A1 3/2014 Rossing et al.

FOREIGN PATENT DOCUMENTS

JP 2002027588 1/2002
JP 2008241899 10/2008
JP 2008271436 11/2008
WO 2010137997 12/2010

OTHER PUBLICATIONS

Canadian Office Action, dated Oct. 17, 2016, for Application 2,909,441.
Extended European Search Report, dated Oct. 12, 2016, for Application 14770864.8.

* cited by examiner

DECORATIVE FLAT PANEL SOUND SYSTEM

CROSS-REFERENCE RELATED APPLICATIONS

This application claims the benefit of U.S. Provisional Application No. 61/786,051, with a filing date of Mar. 14, 2013, the entirety of which is incorporated herein by reference.

BACKGROUND AND SUMMARY

The present invention is directed, in general, to sound systems and, in particular, to a decorative or unobtrusive flat panel sound system.

Sound systems are used in a variety of contexts including television sound systems, radio or stereo sound systems, music systems, telephone systems and the like. In these contexts, the sound system generally includes an audio source for receiving or generating an audio signal, an amplifier for amplifying the audio signal, one or more speakers for rendering the amplified audio signal as one or more acoustic signals, and related electronic components for multiplexing, demultiplexing, digital to analog conversion and other conditioning of the electronic signal. Such sound systems may be generally understood as encompassing personal sound systems—such as headphones, earbuds, and the like—where sound intended for personal use is generated in close proximity to the ear or ears of the user, and loudspeaker sound systems where sound is generated for one or more users in a listening area.

Conventionally, speaker systems have been fairly substantial systems from a physical perspective, often housed in cabinets or similar structures. High quality sound systems often include multiple speaker components in a single unit for generating sounds in specific frequency ranges, e.g., sub-bass, bass, mid-range, and high frequency speaker components. While sound systems can generate high quality sound, they take up substantial room, both in terms of area and depth. Moreover, the sound production function of speaker systems generally requires that they be in the open (not enclosed), and distributed in relation to the intended listening area, which may be a living room, office, or other room designed and decorated with care. In many cases, users desire the sound quality of such sound systems, but are bothered by the aesthetics of bulky speaker systems. Flat panel speakers have been developed that avoid the need for cabinet-type speakers. However, these have generally been conceived as speakers, not fully functional sound systems, and may require power cords and/or connections for delivery of sound signals, thereby undermining the aesthetics and functionality of the speakers, or requiring complicated and expensive installation. There remains a need for sound systems which are unobtrusive or decorative, and that are highly functional and easy to use.

SUMMARY OF THE INVENTION

The present invention is directed to a sound system with a flat panel speaker that does not require external cabling or wiring for sound signal delivery or other interface to a receiver/amplifier unit. Such a system may further include an internal power source to eliminate the need for power cables. In this manner, the speaker or speakers can be decorative (embodied in a picture, mirror or other decorative/functional product) or unobtrusive (e.g., incorporated into a wall panel or otherwise hidden or camouflaged), without any visible external components to destroy or diminish the desired effect. Moreover, the sound system can be installed via either a wired or wireless interface, e.g., using an iPod™ system, mobile device, receiver/amplifier, or media server, such that a convenient and rich user interface is not sacrificed to achieve the desired aesthetics.

In accordance with one aspect of the present invention, a flat panel sound system is provided. The system includes at least one flat speaker panel for producing acoustic signals, at least one audio exciter for driving the flat speaker panel in response to electronic audio signals, and a data interface for receiving inputs from a user interface device and controlling the audio exciter in response to the inputs. The at least one audio exciter and the data interface are supported by a common structure for mounting on a wall. For example, the data interface and audio exciters may be mounted on a frame and the flat speaker panel can be mounted on the audio exciters to float with respect to the frame.

In one embodiment, the data interface is a wireless interface for receiving wireless inputs from a user interface device. For example, the user interface device may be an iPod™, a mobile device, or a computer. The data interface may receive communications from the user interface device in accordance with a defined protocol such as Airplay™, Bluetooth™, upnp, and DNLA. Alternatively, the data interface may be an Ethernet interface, a USB port, or an analog signal port.

The sound system may further comprise a mounting structure for mounting the sound system on a wall and a damping system for inhibiting transmission of vibrations between the sound system and wall. The damping system may be an active damping system or a passive damping material. In one embodiment, a passive damping material is disposed between a frame of the sound system and the wall. In addition to providing the noted function of inhibiting transmission of vibrations, the damping system provides clearance between the frame of the sound system and the wall so that sound waves can emanate into the room from the back of the flat panel.

In accordance with another aspect of the present invention, a method for constructing a flat panel sound system is provided. The method includes the steps of providing at least one flat speaker panel and mounting a sound kit and the flat speaker panel on a common structural support. The sound kit includes at least one exciter, an amplifier and associated circuitry. The sound system may further include a wireless connection for receiving user inputs from a separate user interface device. In this manner, a rich user interface may be provided without impairing the aesthetics of the sound system.

BRIEF DESCRIPTION OF THE DRAWINGS

For a complete understanding of the present invention, and further advantages thereof, reference is now made to the following detailed description, taken in conjunction with the drawings in which.

DESCRIPTION OF THE INVENTION

The present invention is directed to a flat panel sound system. The sound system can be used in a variety of contexts such as providing sound for radio, television, music, telephone or other devices having an audio output. In addition, the flat panel system can be embodied in a variety of decorative or unobtrusive forms such as a picture, a projection screen, a clock, a mirror, a white-board, a wall panel, etc. The following description describes the invention in the exemplary context of a wall-mounted sound system associated with a mobile device such as an Apple iPhone™ or data enabled mobile device or any communication protocol including servers, custom apps, etc. It should be expressly understood that the invention is not limited to such embodiments or contexts. For example, a wired connection for Ethernet and/or power may be utilized instead of implementing the system as a fully wireless unit.

Figure 1:
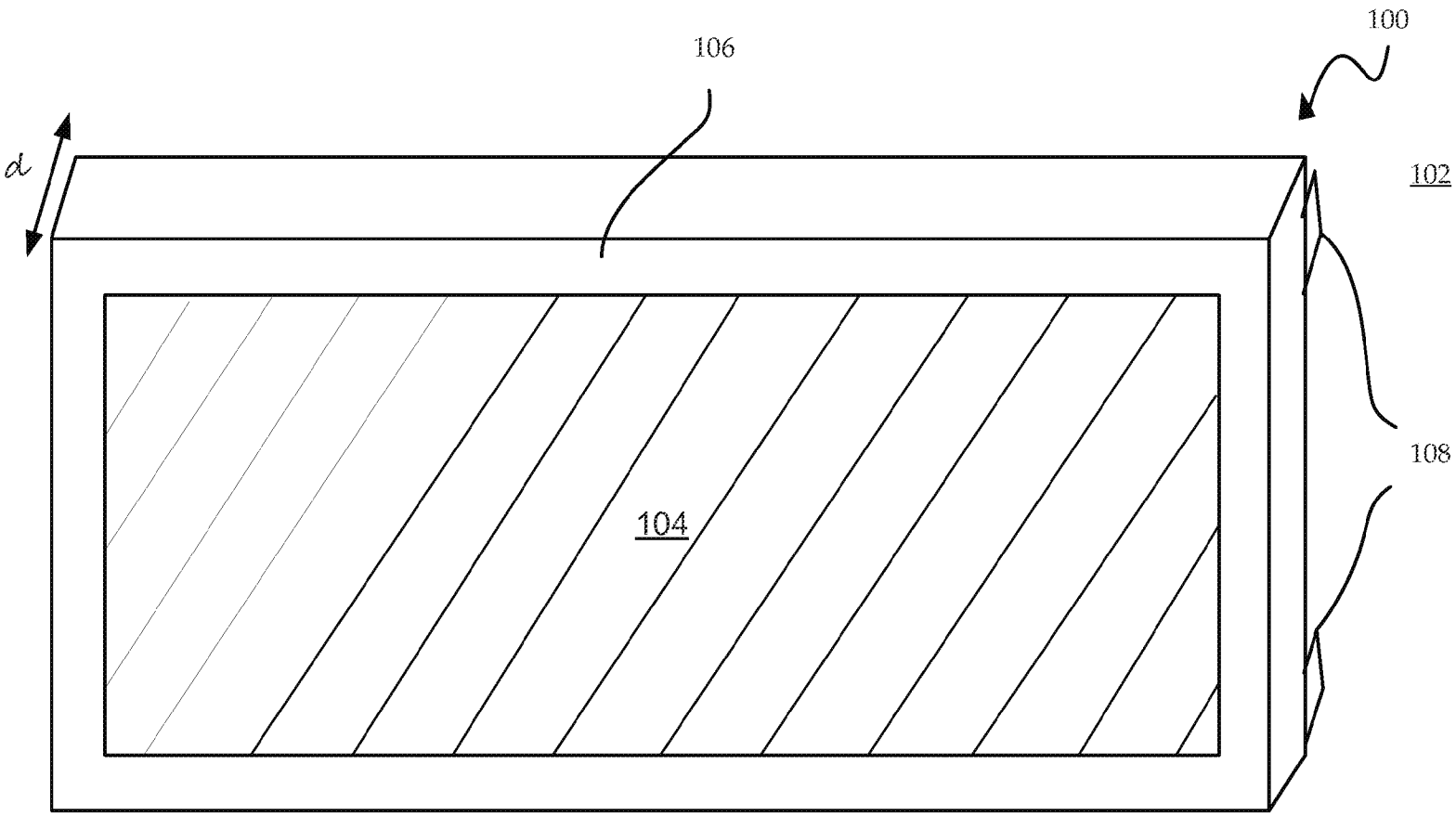
FIG. 1 is a front perspective view of a flat panel sound system in accordance with the present invention.

FIG. 1 illustrates a sound system 100 in accordance with the present invention. The illustrated system 100 is a flat panel system adapted to be mounted on a wall 102. The sound system 100 is designed to be decorative or unobtrusive. For example, the system 100 may not appear to be a sound system at all to the casual observer, but may instead appear to be a picture, a mirror, a white-board or the like. In this regard, the illustrated system 100 has a front surface 104 that may have a picture printed on it, or may otherwise be treated in a manner so that it can function as a white-board, projection screen, or mirror. As will be understood from the description below, the front surface of 104 may be formed from a rigid foam board, fiber board or other lightweight, rigid material that operates as a flat speaker panel.

The flat speaker panel, in the illustrated embodiment, is housed within a frame 106. The frame 106 may be mounted on the rigid foam board or the foam board may be allowed to move independently of the frame 106 when generating acoustic waves. For example, the foam board may be mounted to float in relation to the frame similar to the mounting of conventional speaker cases. The illustrated sound system 100 also includes buffering devices 108, as will be described in more detail below, that serve to isolate the system 100 from the wall 102 so as to inhibit transmission of vibrations between the wall and sound system. The buffering devices 108 also facilitate transmission of sound waves from the back of the speaker panel into the surrounding environment.

The illustrated sound system 100 may be provided in a variety of dimensions. For example, the front surface of the system 100 may have a size typical of wall mounted pictures. For example, the system 100 may have a width between about 2 to 6 feet and height between about 1 to 4 feet. However, other sizes and aspect ratios are possible. The illustrated system 100 has a narrow depth, d, of less than about 6 inches and, more preferably, less than about 4 inches. For example, the illustrated system 100 may have a depth, d, between about 2.5-3 inches.

Figure 2:
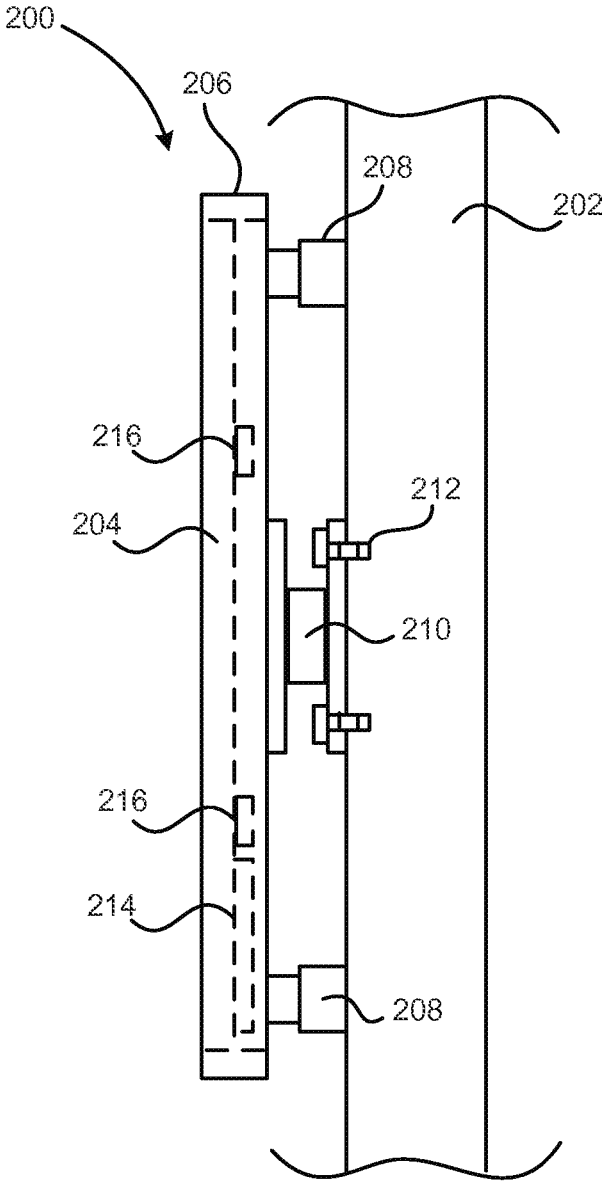
FIG. 2 is side view of the flat panel sound system of FIG. 1.

FIG. 2 shows a side view of a flat panel sound system 200 in accordance with the present invention mounted on a wall 202. The illustrated system 200 includes a rigid foam board flat panel 204 mounted within a frame 206. The system 200 further includes a sound kit 214 mounted on the panel 204 or mounted on the same structural frame as the panel 204. As will be described in more detail below, the sound kit may include an amplifier, a computer, an RF antenna, an optional power source such as a battery, and integration circuitry. In lieu of or in addition to the battery, the system 200 may utilize a power connection to the system 200 (e.g., a 120 v ac to 12 v dc or 19 v dc power supply. Also provided as part of the kit are audio exciters 216 that may be connected to the noted components 214 via wires extending behind the foam board 204. The system 200 may further include interface slots for connecting additional or external components such as battery recharger cables, USB flash drives, or other components.

The illustrated system 200 is mounted to the wall 202 using a mounting bracket 210. The mounting bracket may connect to the frame 206, a cross member, or the like and preferably provides sufficient clearance from the wall to provide high quality sound. In this regard, the bracket may be manually or automatically movable to extend the sound system further from the wall. The manner of mounting the system 200 on the wall 202 allows the foam board panel 204 to float as necessary to generate acoustic signals. The illustrated system further includes damping elements 208 for inhibiting transmission of vibrations between the wall 202 and the system 200. These devices 208 may be active or passive. For example, the devices 208 may comprise a resilient material such as foam, may include spring-based shock absorbers or may incorporate electronically driven vibration cancelation units.

Figure 3:
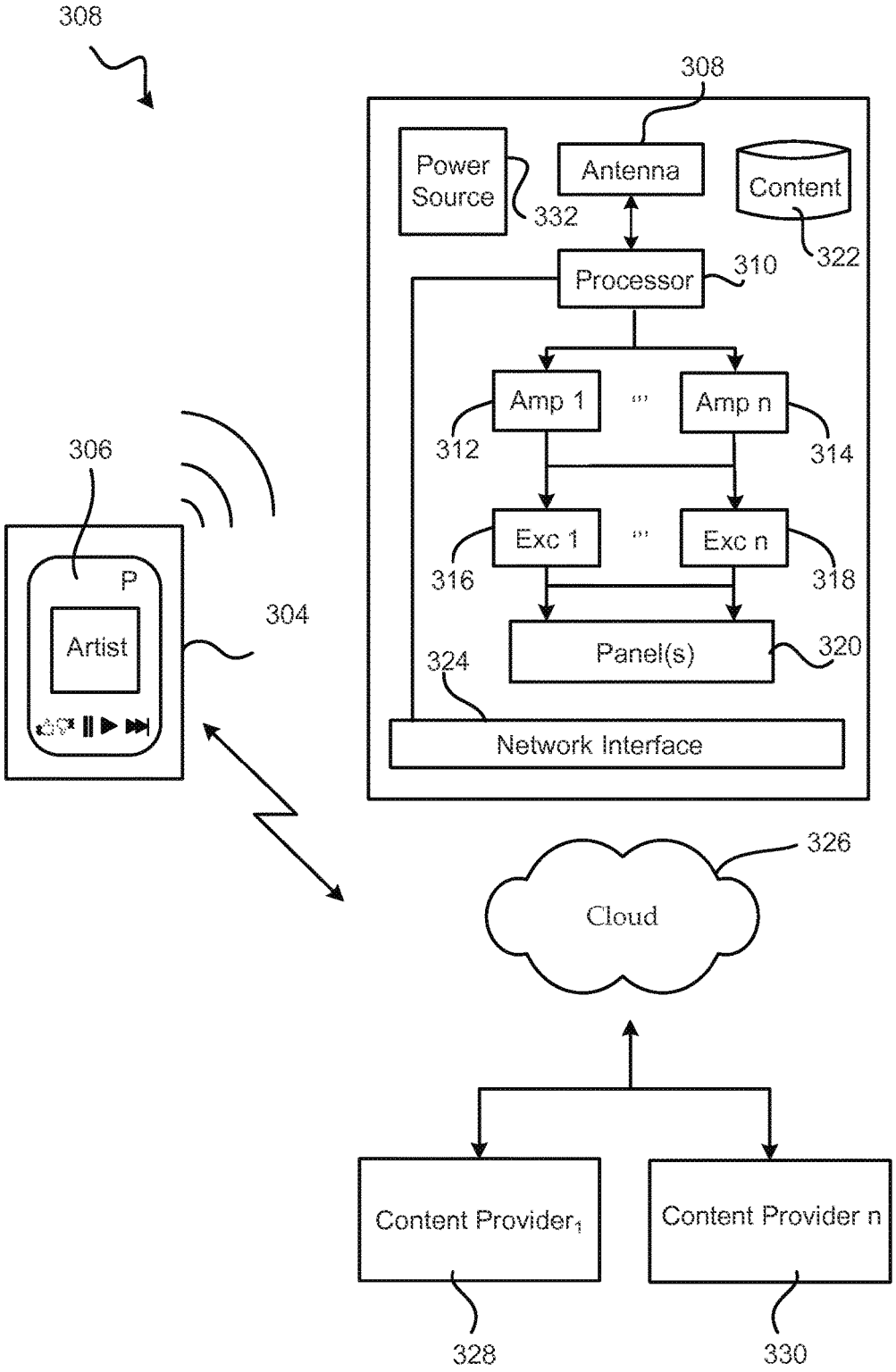
FIG. 3 is a schematic diagram of a flat panel sound system in accordance with the present invention.

FIG. 3 is a partially schematic diagram of a sound system 300 in accordance with an alternative implementation of the present invention. The illustrated system 300 includes a flat panel speaker system 302 that is wireless controlled by a user interface device 304. The user interface device 304 includes a user interface element, a processor and related circuitry, and a wireless transmitter such as RF antenna, infrared transmitter, or the like. The user interface element, for example, may include a touch screen, a keyboard, a stylus, and/or a graphical user interface. The user interface device 304 may be embodied in a laptop, tablet computer, desktop computer or other data terminal, a mobile unit (e.g., running an Apple™, Droid™, Windows™ or other operating system), an iPod™ (particularly if it supports WIFI and AirPlay™) or other mobile music platform, a television, a stereo or other device. In the illustrated embodiment, the user interface 304 is a data enabled mobile unit.

The speaker system 302 includes an antenna 308, sensor or other unit for receiving the signals from the user input device 304 and a processor 310 for controlling operation of the speaker system 302. In addition, the speaker device 302 includes a number (one or more) of amplifiers 312, 314 and a number of exciters 316, 318 for driving one or more flat speaker panels 320. Multiple amplifiers and exciters may be used to increase volume and to achieve various effects such as stereo sound. The speaker system 302 may further include stored content 322, for example, stored on a removable flash drive or on an integrated solid state storage device. For example, music content may be stored at the speaker system 302, on the user interface device 304 or may be streamed from an external source as will be described below. The system may also include a power source 332, such as a rechargeable battery or a power line for connection to a power outlet.

The illustrated speaker system 302 further includes a network interface 324 such as a connection to a wireless network, wireless router, a hot spot, or the like. Alternatively a wire-line Ethernet connection or the like may be provided as a network interface. Such a network interface may be utilized to access streaming content such as web-based radio or to download content from various online sources. In the illustrated embodiment, the network interface 324 can be used to access content from content providers 328, 330 via a cloud architecture 326. Such content may be streamed in real-time or may be stored in content storage 322.

Alternatively, the user interface device 304 may be utilized to directly access content from the content providers 328, 330, or to access any data network, radio network or other broadcast sources, and to transmit to the content to the speaker system 302. In the latter regard, it will be appreciated that it is not necessary for the speaker device 302 to include a network interface (other than via user interface device 304) or locally stored content 322.

Figure 4:
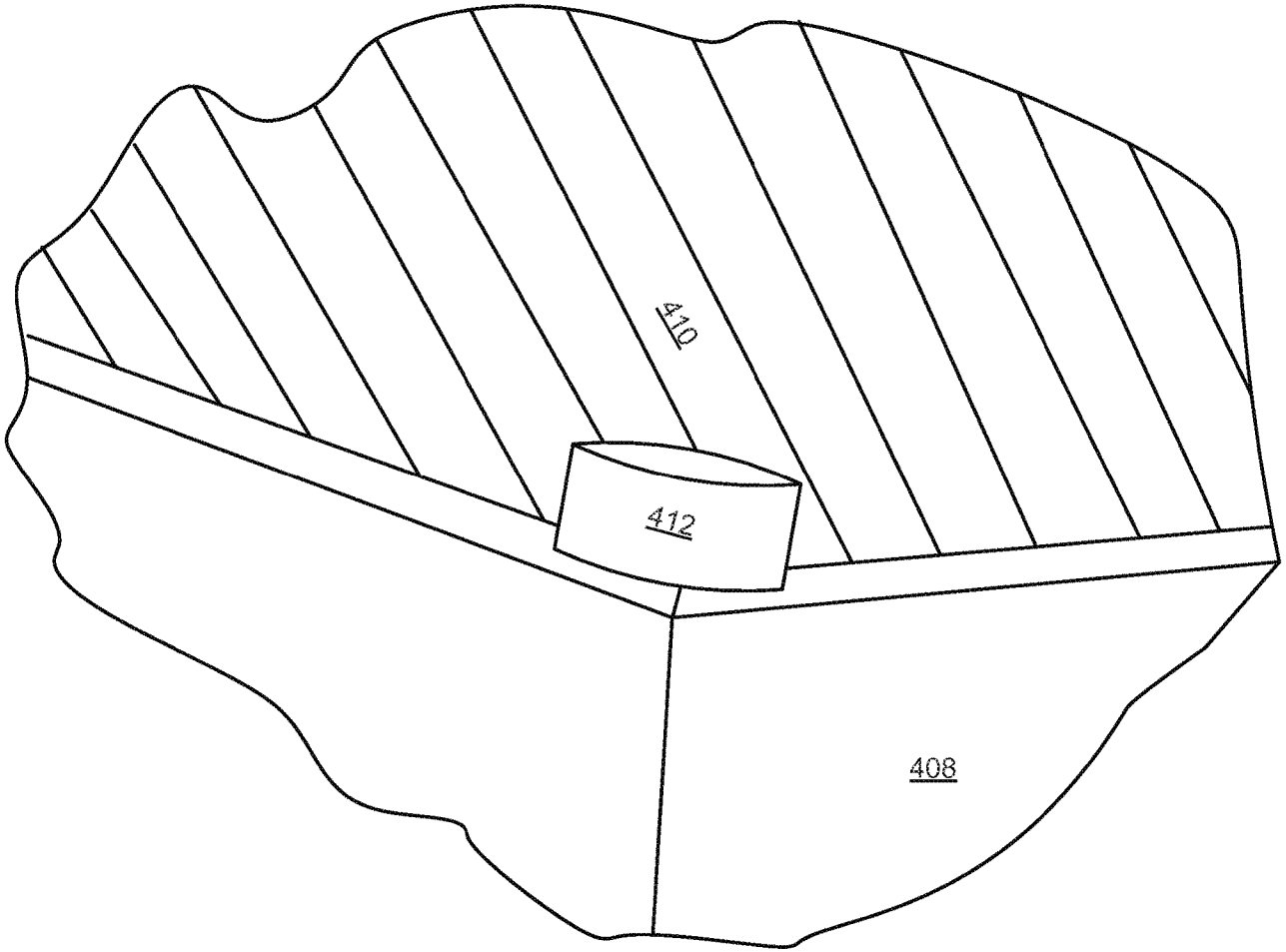
FIG. 4 is partial rear perspective view of an alternative embodiment of a flat panel sound system in accordance with the present invention.
Figure 5:
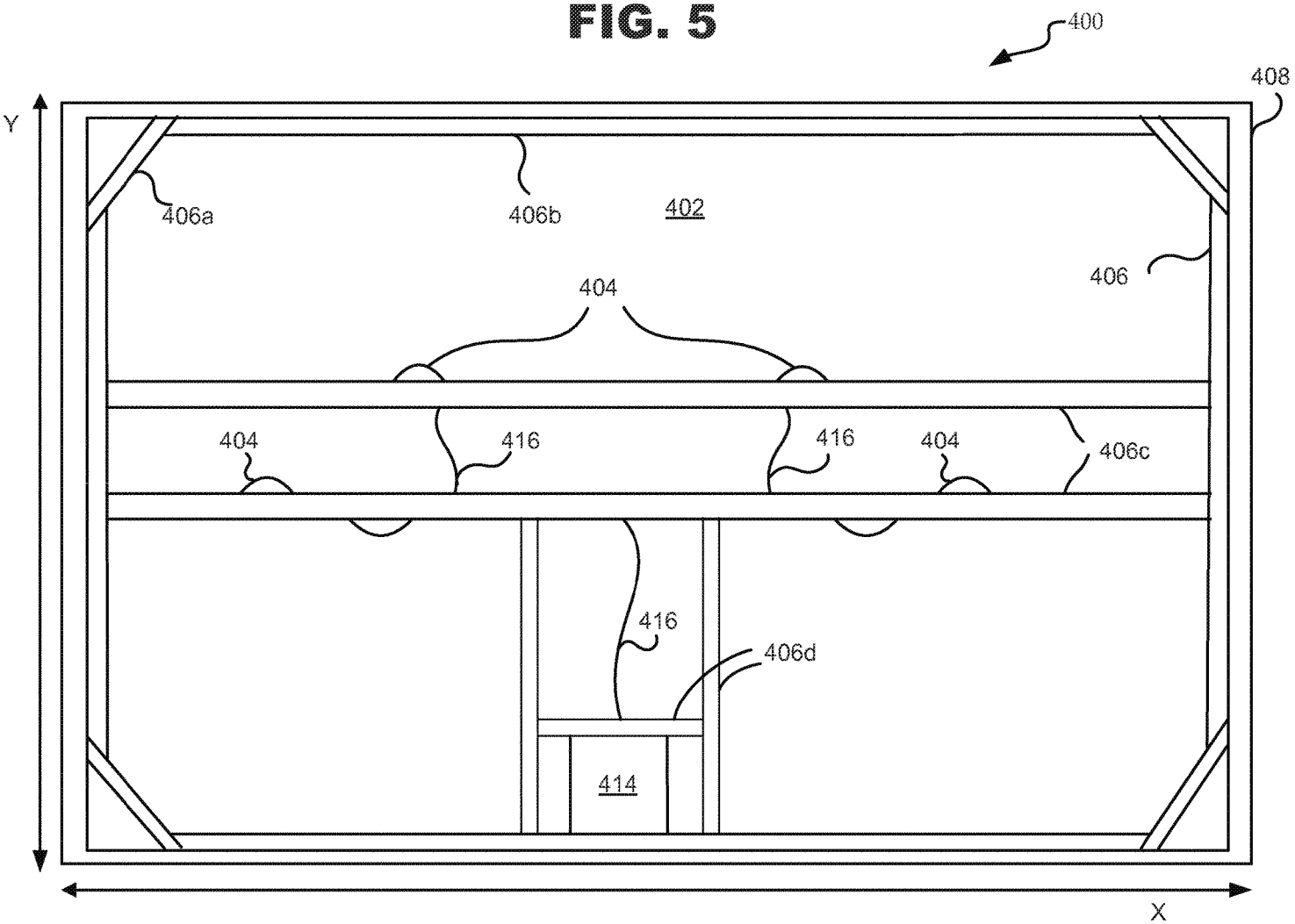
FIG. 5 is a rear elevation view showing the flat panel sound system of FIG. 4 with a backing removed to reveal internal components.
Figure 6:
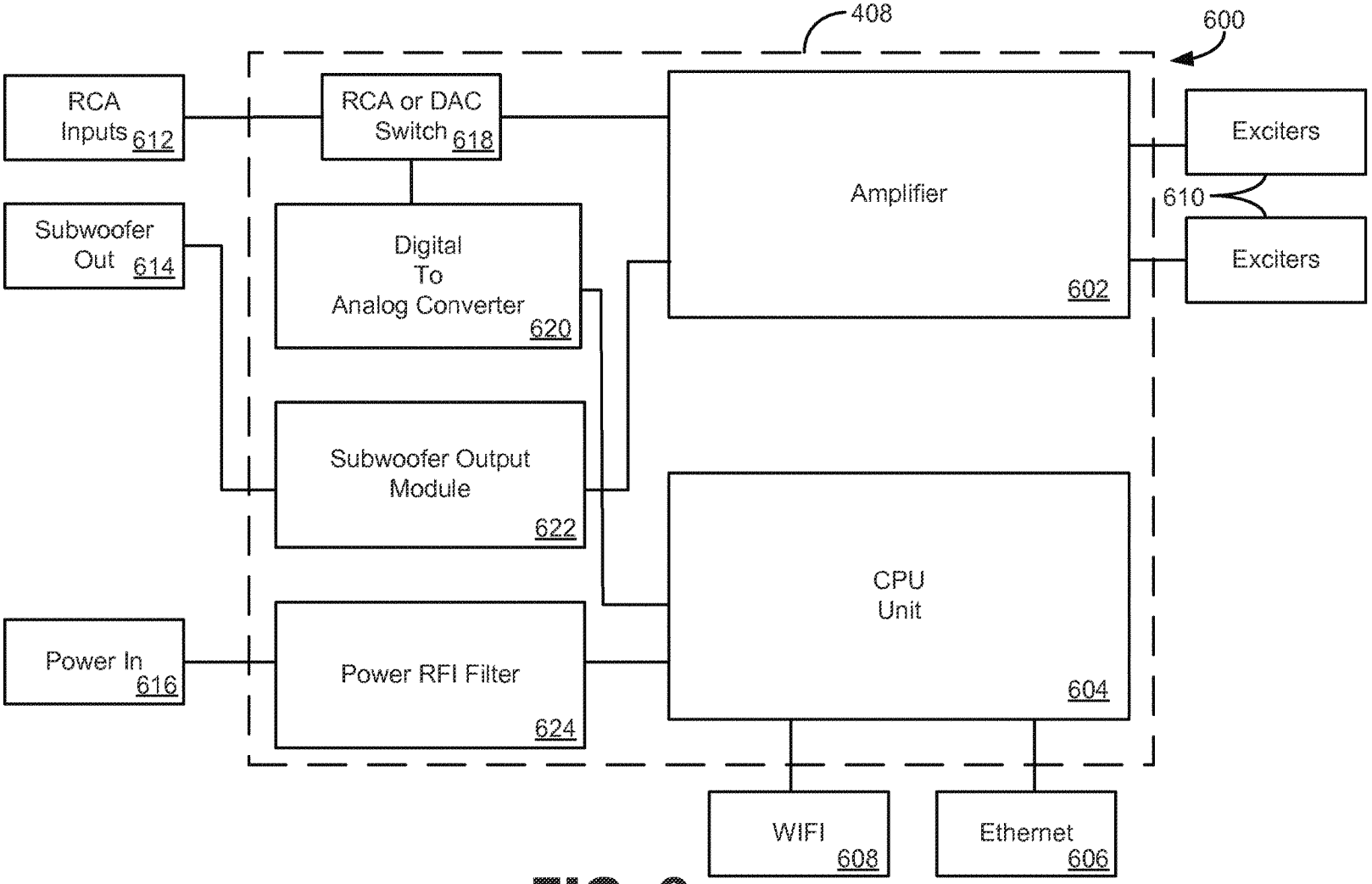
FIG. 6 is a schematic diagram showing electronic components of the flat panel sound system of FIG. 4.

FIGS. 4-6 illustrate a further embodiment of a sound system 400 in accordance with the present invention. In particular, FIG. 4 shows a partial back perspective view of the sound system 400. FIG. 5 shows a back view with the acoustic backing removed to reveal certain internal structure. FIG. 6 is a schematic diagram of the electronics of the sound system 400.

The sound system 400 is generally a flat panel sound system such as described above, but with some differences relating to arrangement of components and a few variations of features. More specifically, the sound system 400 generally includes a flat panel 402 for generating sound. The flat panel 402 is driven by exciters 404 mounted on frame 406. The frame 406, in turn, is supported by a housing 408. As described above, the sound system 400 can be hung or otherwise mounted on a wall and the front surface of the panel 402 may have artwork or other graphics/treatment so that the sound system 400 is unobtrusive or attractive in appearance.

As shown in FIG. 4, the illustrated sound system 400 includes an acoustic backing 410 and stand-offs 412 on its back side. The backing 410 is formed from material that allows sound waves to pass through the backing with minimal attenuation or distortion. It has been found that transmitting sound from the back surface as well as the front surface of the panel 402 significantly enhances sound quality. For example, the backing may be formed from any of various natural or synthetic, woven, or mesh materials forming a sound permeable weave or mesh. For example, the backing 410 may be formed from a sheet of loose nylon weave fabric or conventional sound speaker fabric. The backing 410 thus serves the dual function of transmitting sound rearwardly from the panel 402 and covering/protecting the internal structural and electronic components.

The illustrated system 400 further includes stand-offs 412 interposed between the frame 406 (FIG. 5) and/or housing 408 and the wall on which the system 400 is mounted. As noted above, it is desired to transmit sound from the back surface of the panel 402. The stand-offs 412 facilitate transmission of these sound waves into the room or other surrounding environment by providing a gap between the housing 408 and the wall for substantially uninhibited sound transmission. The stand-offs 412 further inhibit transmission of vibrations from the system 400 to the wall. As noted above, the stand-offs 412 can include active vibration canceling devices, moving mechanical devices (e.g., spring-based systems, pneumatic cylinders, or the like), and/or can include passive buffer materials. In the illustrated embodiment, the stand-offs are formed from woven fabric pads having a thickness (front-to-back), for example, of between about 0.25-1.0 inches. The stand offs are disposed near the corners of the housing 408 and may be supported, for example, on the housing 408 and corner braces 406*a* of the frame 406 (e.g., with the backing 410 sandwiched therebetween).

The housing 408 has a depth (front-to-back) sufficient to house the frame 406, electronic and other internal components. In this regard, the frame may be between about 1.0-8.0 inches deep, e.g., 2.0-6.0 inches deep. The frame 406 may be formed from any suitable material such as wood, particle board, metal, plastic, or composite materials.

FIG. 5 shows the system 400 with the backing removed so that the internal components can be observed. The internal components include the frame 406, electronics housing 414, the exciters 404 and wiring 416 for connecting the exciters 404 to the electronics located within housing 414.

The illustrated frame 406 includes peripheral segments 406*b* (which may be separate from or integral with the housing 408), crossmembers 406*c*, electronics support members 406*d* and cover braces 406*a*. The exciters 404 are mounted on the crossmembers 406*c* and are positioned to provide optimal sound. In the illustrated embodiment, there are four at least exciters 404 and they are positioned as follows (where the width of the panel 402 is x and the height is y, with the origin of the lower, left corner of the panel as viewed from the front):

Exciters 1: 4/9 X, 3/7 Y
Exciters 2: 4/7 X, 5/9 Y
Exciters 3: 3/7 X, 4/7 Y
Exciters 4: 5/9 X, 4/9 Y The support structure for the exciters enhances the sound quality including improved bass performance.

The illustrated electrical support members 406*d* are configured to support the electronics housing 414 in a bottom, center position in relation to the housing 408. This is a particular advantageous location for the electronics housing 414 as optional ethernet cables, recharger cords, flash drives, power cords, and the like, can be ported adjacent to the electronics housing 414 (e.g., via ports provided on a bottom edge of the system 400) with minimal visual impact and less tendency to pull the system 400 crooked on the wall. The corner braces 406*a* provide rigidity to the frame 406 and provide support surfaces for the stand-offs 412. The frame 406 may be formed from any suitable material(s) such as wood, particle board, plastics, metals, and/or composite materials, and the various components of the frame 406 can be formed from the same or different materials. The panel 402 can be formed of various lightweight, rigid materials, such as foamboard or carbon fiber board.

As discussed above, various options are available with regard to picture framing. For example, the system 400 can be in a picture frame (supported on the panel 402 or supported on the frame 406 or hanging 408 such that the panel 402 floats in relation to the picture frame) or can be frameless (the edges of the panel 402 are flush with the frame 406).

FIG. 6 illustrates the electronic components 600 of the sound system 400. Though various configurations are possible, the components within the box shown in phantom are housed within the housing 408 of the illustrated embodiment. The sound system 400 may receive inputs from a variety of sources including wireless networks, other data networks, flash drives, mobile devices, televisions, etc. In this regard, the sound system 400 may be configured with ports to receive such inputs. In the illustrate example, the sound system 400 includes an Ethernet port 606 (e.g., for receiving an Ethernet cable), a WIFI port 608, RCA inputs 612, a power in port 616 (e.g., for receiving a power cord or recharger cord). It will be appreciated that other ports such as a USB port and/or other types of audio jacks may be provided. The electronic components 600 also include outputs to drive the panel 602 and external components. In the illustrate example, the outputs include the exciters 610 and a subwoofer 614. For example, one or more separate subwoofer units may be driven by the electronic components 600 via a wired or wireless connection.

The electronic components 600 further include an amplifier 602 and a CPU unit 604. The CPU unit 604 generally executes all of the logic necessary to: receive and decode, demodulate, and otherwise process as necessary the input signals; drive the various internal and external components; and otherwise manage operation of the sound system 400. It will be appreciated that although a single CPU unit 604 is shown, the noted functionality may be distributed over multiple units and may be shared between logic resident on the sound system 400 and external systems.

The amplifier 602 amplifies and otherwise conditions signals from the CPU unit 604 for driving the exciters 610 and the subwoofer output module 622. The amplifier 602 may receive analog inputs or digital signals from the CPU unit. In the case of digital signals, the signals can be converted to analog by the digital to analog converter 620. Switch 618 allows the amplifier 602 to receive signals from the RCA input 612 or from the CPU unit 604 via the digital to analog converter 620.

The illustrated electronic components 600 further include a subwoofer output module 622 and a power RFI filter 624. The RFI filter 624 removes radio frequency interference from the power in signal for improve performance. The subwoofer output module 622 drives the subwoofer via a wireless output, fiber output or other cable output.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A sound system comprising:

at least one flat speaker panel for producing acoustic signals;

at least one audio exciter, associated with said flat speaker panel, for driving said flat speaker panel to produce acoustic signals in response to electronic audio signals; and a data interface, operatively associated with said audio exciter, for receiving inputs from a user interface device and controlling said audio exciter in response to said inputs;

said at least one audio exciter and said data interface being supported by a common structural unit for mounting on the outer surface of a wall, said common structural unit further supporting an acoustic backing, disposed between said flat speaker panel and said outer surface of said wall, formed from material for allowing sound waves to pass through the acoustic backing with minimal attenuation; and mounting structure for mounting said common structural unit on a wall such that clearance is provided between a back of said common structural unit and said wall, said mounting structure including at least a mounting support assembly for supporting a weight of said sound system on said wall, and a damping mechanism, separate from said mounting support assembly, for inhibiting transmissions of vibrations between the sound system and the wall.

2. A sound system as set forth in claim 1, wherein said data interface is a wireless interface for receiving wireless inputs from said user interface device.

3. A sound system as set forth in claim 1, wherein said data interface is an Ethernet interface.

4. A sound system as set forth in claim 1, wherein said flat speaker panel, said audio exciter and said wireless interface are fully contained in a flat speaker system having a substantially planar front surface and a depth, wherein said depth is no more that about four inches.

5. A sound system as set forth in claim 4, wherein said flat speaker system further comprises a power source and a digital to analog amplifier.

6. A sound system as set forth in claim 4, wherein said flat speaker system further comprises a multi-purpose computer.

7. A sound system as set forth in claim 2, further comprising a controller, operatively associated with said wireless interface, for wirelessly communicating with said user interface device in accordance with a defined communications protocol.

8. A sound system as set forth in claim 7, wherein said defined protocol comprises one of Airplay™, Bluetooth™, upnp, and DNLA.

9. A sound system as set forth in claim 1, wherein said flat speaker panel comprises a lightweight substantially rigid structure.

10. A sound system as set forth in claim 1, wherein said flat speaker panel comprises a rigid foam-core material or other lightweight rigid materials such as mylar, carbon fiber, wood veneer or a honeycomb interior enclosed in paper on the front and back.

11. A sound system as set forth in claim 1, wherein said sound system comprises a sound kit mounted on said flat speaker panel.

12. A sound system as set forth in claim 11, wherein said sound kit comprises said exciter, an amplifier and associated circuitry.

13. A sound system as set forth in claim 1, wherein said wireless interface comprises an RF antenna.

14. A sound system as set forth in claim 1, wherein a front surface of said flat speaker panel is adapted for a decorative or unobtrusive appearance.

15. A sound system as set forth in claim 14, wherein said front surface is configured as one of a picture, a mirror, a white-board, a projection screen, a clock or a wall panel.

16. A sound system as set forth in claim 1, further comprising said user interface device.

17. A sound system as set forth in claim 16, wherein said user interface device comprise one of an iPod™, a mobile device, and a computer.

18. A sound system as set forth in claim 1, further comprising a picture frame for framing a front surface of said flat speaker panel.

19. A sound system as set forth in claim 1, further comprising a damping system, disposed between said common structural unit and said wall, for inhibiting transmission of vibration between said sound system and said wall.

20. A sound system as set forth in claim 19, wherein said damping system comprising a passive damping material.

21. A sound system as set forth in claim 1, further comprising a mounting bracket for mounting said flat speaker panel on a wall such that sufficient clearance is provided between said flat speaker panel and said wall so as to provide high quality sound.

22. A sound system comprising:

at least one flat speaker panel for producing acoustic signals;

a sound kit structurally interconnected to said flat speaker panel, said sound kit comprising an exciter, an amplifier and associated circuitry, said at least one flat speaker panel and said sound kit being supported by a common structural unit, said common structural unit further supporting an acoustic backing, disposed between said flat speaker panel and a wall, formed from material for allowing sound waves to pass through the acoustic backing with minimal attenuation; and mounting structure for mounting said common structural unit on said wall such that clearance is provided between a back of said common structural unit and said wall, said mounting structure including at least a mounting support assembly for supporting a weight of said sound system on said wall, and a damping mechanism, separate from said mounting support assembly, for inhibiting transmissions of vibrations between the sound system and the wall.

23. A method for use in constructing a sound system comprising, the steps of:

providing at least one flat speaker panel for producing acoustic signals;

mounting a sound kit and said flat speaker panel on a common structural support, said common structural support further supporting an acoustic backing, disposed between said flat speaker panel and a wall, formed from material for allowing sound waves to pass through the acoustic backing with minimal attenuation, said sound kit comprising an exciter, an amplifier and associated circuitry, and mounting said common structural support on said wall such that a clearance is provided between a back of said common structural unit and said wall, said mounting comprising using mounting structure including at least a mounting support assembly for supporting a weight of said sound system on said wall, and a damping mechanism, separate from said mounting support assembly, for inhibiting transmissions of vibrations between the sound system and the wall.

24. A method as set forth in claim 23, wherein said sound kit further comprises a wireless interface and said method comprises receiving wireless inputs from said user interface device.

25. A method as set forth in claim 24, further comprising operating with said wireless interface for wirelessly communicating with said user interface device in accordance with a defined communications protocol.

26. A method as set forth in claim 25, wherein said defined protocol comprises one of Airplay™, Bluetooth™, upnp, and DNLA.

27. A method as set forth in claim 24, wherein said user interface device comprise one of an iPod™, a mobile device, and a computer.

28. A method as set forth in claim 23, further comprises mounting said sound system on a wall and disposing a damping system for inhibiting transmission of vibration between said sound system and said wall.

29. A method as set forth in claim 28, wherein said damping system comprises a passive damping material.

30. A method for operating a sound system, comprising the steps of:

providing at least one flat speaker panel for producing acoustic signals, at least one audio exciter, associated with said flat speaker panel, for driving said flat speaker panel to produce acoustic signals in response to electronic audio signals, and a wireless interface, operatively associated with said audio exciter, for receiving wireless inputs from a user interface device and controlling said audio exciter in response to said wireless inputs;

mounting said flat speaker panel, said at least one audio exciter, and said wireless interface on a common structural support, said common structural support further supporting an acoustic backing, disposed between said flat speaker panel and a wall, formed from material for allowing sound waves to pass through the acoustic backing with minimal attenuation;

mounting said common structural support on mounting structure for mounting said common structural unit on said wall such that clearance is provided between a back of said common structural unit and said wall, said mounting structure including at least a mounting support assembly for supporting a weight of said sound system on said wall, and a damping mechanism, separate from said mounting support assembly, for inhibiting transmissions of vibrations between the sound system and the wall; and operating said user interface device to transmit said wireless inputs.

* * * * *